US009239529B2

(12) United States Patent
Nosella et al.

(10) Patent No.: US 9,239,529 B2
(45) Date of Patent: Jan. 19, 2016

(54) TONER COMPOSITIONS AND PROCESSES

(75) Inventors: Kimberly D. Nosella, Mississauga (CA); Daryl W. Vanbesien, Burlington (CA); Allan K. Chen, Oakville (CA); Sonja Hadzidedic, Oakville (CA)

(73) Assignee: Xerox Corporation, Norwalk, CT (US)

( * ) Notice: Subject to any disclaimer, the term of this patent is extended or adjusted under 35 U.S.C. 154(b) by 600 days.

(21) Appl. No.: 12/972,920

(22) Filed: Dec. 20, 2010

(65) Prior Publication Data

US 2012/0156610 A1 Jun. 21, 2012

(51) Int. Cl.

| | |
|---|---|
| ***G03G 9/087*** | (2006.01) |
| ***G03G 9/08*** | (2006.01) |
| ***G03G 9/09*** | (2006.01) |

(52) U.S. Cl.

CPC ..... *G03G 9/08755* (2013.01); *G03G 9/0804* (2013.01); *G03G 9/0821* (2013.01); *G03G 9/08795* (2013.01); *G03G 9/08797* (2013.01); *G03G 9/09* (2013.01)

(58) Field of Classification Search

CPC ..... G03G 9/08797; G03G 9/09392; G03G 9/08755

USPC ..... 430/137.14

See application file for complete search history.

(56) References Cited

U.S. PATENT DOCUMENTS

| | | | |
|---|---|---|---|
| 3,590,000 | A | 6/1971 | Palermiti et al. |
| 3,655,374 | A | 4/1972 | Palermiti et al. |
| 3,720,617 | A | 3/1973 | Chatterji et al. |
| 3,847,604 | A | 11/1974 | Hagenbach et al. |
| 3,944,493 | A | 3/1976 | Jadwin et al. |
| 3,983,045 | A | 9/1976 | Jugle et al. |
| 4,007,293 | A | 2/1977 | Mincer et al. |
| 4,079,014 | A | 3/1978 | Burness et al. |
| 4,295,990 | A | 10/1981 | Verbeek et al. |
| 4,394,430 | A | 7/1983 | Jadwin et al. |
| 4,560,635 | A | 12/1985 | Hoffend et al. |
| 4,935,326 | A | 6/1990 | Creatura et al. |
| 4,937,166 | A | 6/1990 | Creatura et al. |
| 5,236,629 | A | 8/1993 | Mahabadi et al. |
| 5,278,020 | A | 1/1994 | Grushkin et al. |
| 5,290,654 | A | 3/1994 | Sacripante et al. |
| 5,302,486 | A | 4/1994 | Patel et al. |
| 5,308,734 | A | 5/1994 | Sacripante et al. |
| 5,330,874 | A | 7/1994 | Mahabadi et al. |
| 5,344,738 | A | 9/1994 | Kmiecik-Lawrynowicz et al. |
| 6,004,714 | A | 12/1999 | Ciccarelli et al. |
| 6,190,815 | B1 | 2/2001 | Ciccarelli et al. |
| 6,593,049 | B1 | 7/2003 | Veregin et al. |
| 6,743,559 | B2 | 6/2004 | Combes et al. |
| 6,756,176 | B2 | 6/2004 | Stegamat et al. |
| 6,803,166 | B2 * | 10/2004 | Cheng et al. ..... 430/137.14 |
| 6,830,860 | B2 | 12/2004 | Sacripante et al. |
| 7,029,817 | B2 | 4/2006 | Robinson et al. |
| 7,329,476 | B2 | 2/2008 | Sacripante et al. |
| 7,358,021 | B2 | 4/2008 | Patel et al. |

(Continued)

*Primary Examiner* — Peter Vajda
*Assistant Examiner* — Olatunji Godo

(57) ABSTRACT

Processes for producing toners are provided. The processes include determining the desired gloss for a given toner, and determining the desired amount of aluminum in the toner to obtain that gloss. Utilizing the processes of the present disclosure, the solids content of an emulsion utilized to produce such a toner, as well as the mixing speed utilized in the aggregation process and the temperature at which aggregation of the toner particles occurs, may then be selected to obtain toner particles possessing the desired amount of aluminum, and thus the desired gloss.

20 Claims, 2 Drawing Sheets

(56) References Cited

U.S. PATENT DOCUMENTS

| | | | | |
|---|---|---|---|---|
| 7,358,022 | B2 | 4/2008 | Farrugia et al. | |
| 2005/0255402 | A1* | 11/2005 | Hopper et al. | 430/137.14 |
| 2006/0216626 | A1 | 9/2006 | Sacripante et al. | |
| 2007/0087281 | A1* | 4/2007 | Patel et al. | 430/110.2 |
| 2008/0107989 | A1* | 5/2008 | Sacripante et al. | 430/109.4 |
| 2008/0107990 | A1 | 5/2008 | Field et al. | |
| 2008/0166647 | A1* | 7/2008 | Mang et al. | 430/108.4 |
| 2008/0236446 | A1 | 10/2008 | Zhou et al. | |
| 2009/0035686 | A1* | 2/2009 | Sacripante | 430/110.2 |
| 2009/0047593 | A1 | 2/2009 | Vanbesien et al. | |
| 2009/0305159 | A1* | 12/2009 | Zhou | G03G 9/0819 430/110.2 |

* cited by examiner

TONER COMPOSITIONS AND PROCESSES

BACKGROUND

This disclosure is generally directed to toner processes, and more specifically, emulsion aggregation and coalescence processes, as well as toner compositions formed by such processes and development processes using such toners for use with electrophotographic copying or printing apparatus.

Toner blends containing crystalline or semi-crystalline polyester resins with an amorphous resin have recently been shown to provide very desirable ultra low melt fusing, which is important for both high-speed printing and lower fuser power consumption. These types of toners containing crystalline polyesters have been demonstrated suitable for both emulsion aggregation (EA) toners, and in conventional jetted toners. Combinations of amorphous and crystalline polyesters may provide toners with relatively low-melting point characteristics (sometimes referred to as low-melt, ultra low melt, or ULM), which allows for more energy-efficient and faster printing.

Emulsion aggregation/coalescing processes for the preparation of toners are illustrated in a number of patents, such as U.S. Pat. Nos. 5,290,654, 5,278,020, 5,308,734, 5,344,738, 6,593,049, 6,743,559, 6,756,176, 6,830,860, 7,029,817, and 7,329,476, and U.S. Patent Application Publication Nos. 2006/0216626, 2008/0107990, 2008/0236446, and 2009/0047593. The disclosures of each of the foregoing patents are hereby incorporated by reference in their entirety.

In the EA process, aggregating agents, including those possessing aluminum, are sometimes used to aggregate the toner particles. However, residual aluminum ions in a toner may reduce the gloss of an image produced with such a toner. Thus, chelating agents may be used to remove the aluminum ions after the aggregation step to achieve target gloss levels in prints made with these toners. When using the same amount of aggregating agent, increasing the amount of chelating agent may remove more aluminum ions from the toner, thus further increasing the toner gloss.

However, one issue which may arise in these processes is batch to batch variability of the aluminum ions in the final toner particles which, in some cases, can be out of target specifications for a toner. Improved toners and methods for their production thus remain desirable.

SUMMARY

The present disclosure provides toners and processes for producing same. In embodiments, a process of the present disclosure includes determining a gloss level for a toner to be produced with an aluminum aggregating agent; determining the amount of aluminum necessary in the dry final toner to produce the gloss level; providing one or more resin emulsions such as amorphous resins, crystalline resins, and combinations thereof, optionally in combination with colorants and waxes to form a toner slurry; adjusting the toner slurry to a pH of from about 2 to about 5, having an overall toner slurry solids content of from about 10% to about 20%; mixing the toner slurry at a speed of from about 100 revolutions per minute to about 900 rpm, in presence of the aluminum aggregating agent to form a mixture; aggregating the mixture to form aggregated particles; heating the aggregated particles to a temperature of from about 35° C. to about 60° C. to freeze particle size thereby forming toner particles; and recovering the toner particles, wherein the solids content, mixing speed, initial slurry pH and heating are each adjusted so that the toner particles possess the gloss level.

In other embodiments, a process of the present disclosure includes determining a gloss level for a toner to be produced with an aluminum aggregating agent such as polyaluminum halides, polyaluminum silicates, and water soluble aluminum salts; determining the amount of aluminum necessary in the toner to produce the gloss level; providing one or more resin emulsions including at least one amorphous resin and at least one crystalline resin, optionally in combination with colorants and waxes to form a toner slurry; adjusting the toner slurry to a pH of from about 2 to about 5, having an overall toner slurry solids content of from about 10% to about 20%; mixing the toner slurry at a speed of from about 100 revolutions per minute to about 900 rpm, in presence of the aluminum aggregating agent to form a mixture; aggregating the mixture to form aggregated particles; heating the aggregated particles to a temperature of from about 35° C. to about 60° C. to freeze particle size thereby forming toner particles; and recovering the toner particles, wherein the solids content, mixing speed, initial slurry pH and heating are each adjusted so that the toner particles possess the gloss level.

In yet other embodiments, a process of the present disclosure includes determining a gloss level for a highly pigmented toner to be produced with an aluminum aggregating agent, the highly pigmented toner being a black toner, a magenta toner, and/or a cyan toner, pigmented with from about 5% to about 50% pigment; determining an amount of aluminum necessary in the toner to produce the gloss level; providing one or more aqueous dispersions, the aqueous dispersions including particles including particles of one or more resins, optionally in combination with colorants and waxes; mixing the aqueous dispersions in the presence of an aluminum aggregating agent to form a mixture; aggregating the mixture to form aggregated particles; heating the aggregated particles to a freeze temperature to stop particle growth, thereby forming toner particles; and recovering the toner particles, wherein the freeze temperature of the highly pigmented black toner particles is calculated using a formula as follows:

$$y=2.616x-57.213 \quad \text{(III)}$$

the freeze temperature of the highly pigmented magenta toner is calculated using a formula as follows:

$$y=3.8993x-87.31 \quad \text{(IV)}$$

and the freeze temperature of the highly pigmented cyan toner is calculated using a formula as follows:

$$y=4.5171x-143.69 \quad \text{(V)}$$

wherein y in each of the above formula III, IV, and V is the desired aluminum content, and x in each of the above formula III, IV, and V is the freeze temperature, in degrees Celsius.

BRIEF DESCRIPTION OF THE FIGURES

Various embodiments of the present disclosure will be described herein below with reference to the figures wherein.

DETAILED DESCRIPTION

Figure 1:
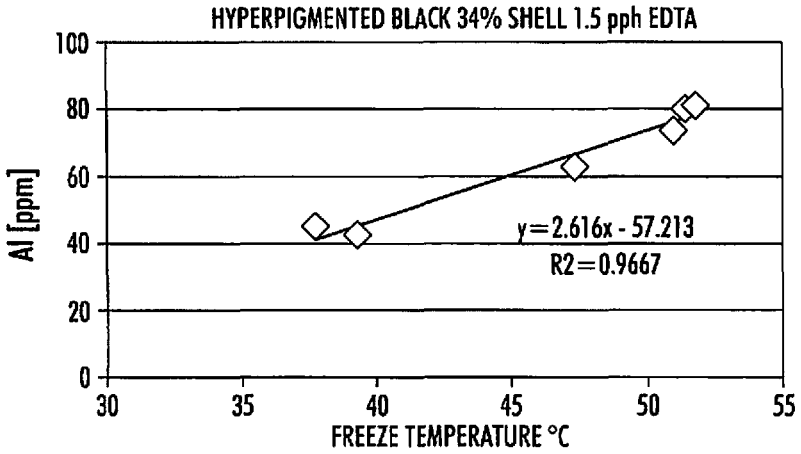
FIG. 1 is a graph depicting the amount of aluminum in a highly pigmented black toner treated with ethylene diamine tetraacetic acid (EDTA), as a function of freeze temperature.

In accordance with the present disclosure, methods for producing low melt EA toners are provided. The toners may be formed from one or more amorphous resin emulsions, a crystalline resin emulsion, optionally a pigment, and optionally a wax. In embodiments, utilizing the methods of the present disclosure, highly pigmented toners may be produced which require less toner to obtain the same image. These highly pigmented toners may exhibit an increase in pigment loading of from about 30% to about 100% higher than nominal. The resulting toners, referred to herein, in embodiments, as highly pigmented toners, have uniform gloss, i.e., lower gloss variation from batch to batch, which improves uniformity of the gloss of an image produced with such a toner.

Resin

Any toner resin may be utilized in the processes of the present disclosure. Such resins, in turn, may be made of any suitable monomer or monomers via any suitable polymerization method. In embodiments, the resin may be prepared by emulsion polymerization. In further embodiments, the resin may be prepared by a method other than emulsion polymerization, such as condensation polymerization.

In embodiments, suitable resins may be polyester resins. Suitable polyester resins include, for example, crystalline, amorphous, combinations thereof, and the like. The polyester resins may be linear, branched, combinations thereof, and the like. Polyester resins may include, in embodiments, those resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

In embodiments, a resin utilized in forming a toner may include an amorphous polyester resin. In embodiments, the resin may be a polyester resin formed by reacting a diol with a diacid or diester in the presence of an optional catalyst.

Examples of organic diols selected for the preparation of amorphous resins include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, and the like; alkali sulfo-aliphatic diols such as sodio 2-sulfa-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol is, for example, selected in an amount of from about 45 to about 50 mole percent of the resin, and the alkali sulfo-aliphatic diol can be present in an amount of from about 1 to about 10 mole percent of the resin.

Examples of diacid or diesters selected for the preparation of the amorphous polyester include dicarboxylic acids or diesters selected from the group consisting of terephthalic acid, phthalic acid, isophthalic acid, fumaric acid, maleic acid, itaconic acid, succinic acid, succinic anhydride, dodecylsuccinic acid, dodecylsuccinic anhydride, dodecenylsuccinic acid, dodecenylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, dimethyl dodecenylsuccinate, and mixtures thereof. The organic diacid or diester may be present, for example, from about 45 to about 52 mole percent of the resin.

Examples of suitable polycondensation catalyst for either the amorphous polyester resin include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or mixtures thereof; and which catalysts are selected in amounts of, for example, from about 0.01 mole percent to about 5 mole percent based on the starting diacid or diester used to generate the polyester resin.

Exemplary amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), a copoly(propoxylated bisphenol A co-fumarate)-copoly(propoxylated bisphenol A co-terephthalate), a terpoly(propoxylated bisphenol A co-fumarate)-terpoly(propoxylated bisphenol A co-terephthalate)-terpoly-(propoxylated bisphenol A co-dodecylsuccinate), and combinations thereof. In embodiments, the amorphous resin utilized in the core may be linear.

In embodiments, a suitable amorphous resin may include alkoxylated bisphenol A fumarate/terephthalate based polyesters and copolyester resins. In embodiments, a suitable amorphous polyester resin may be a copoly(propoxylated bisphenol A co-fumarate)-copoly(propoxylated bisphenol A co-terephthalate) resin having the following formula (I):

(I)

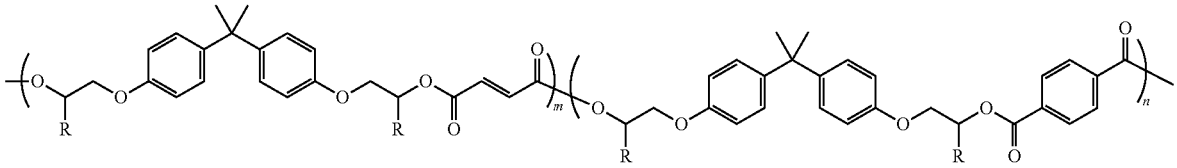

wherein R may be hydrogen or a methyl group, and m and n represent random units of the copolymer and m may be from about 2 to 10, and n may be from about 2 to 10.

An example of a linear copoly(propoxylated bisphenol A co-fumarate)-copoly(propoxylated bisphenol A co-terephthalate) which may be utilized as a latex resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, North Carolina and the like.

In embodiments, the amorphous polyester resin may be a saturated or unsaturated amorphous polyester resin. Illustrative examples of saturated and unsaturated amorphous polyester resins selected for the process and particles of the present disclosure include any of the various amorphous polyesters, such as polyethylene-terephthalate, polypropylene-terephthalate, polybutylene-terephthalate, polypentylene-terephthalate, polyhexylene-terephthalate, polyheptadene-terephthalate, polyoctalene-terephthalate, polyethylene-isophthalate, polypropylene-isophthalate, polybutylene-isophthalate, polypentylene-isophthalate, polyhexylene-isophthalate, polyheptadene-isophthalate, polyoctalene-isophthalate, polyethylene-sebacate, polypropylene sebacate, polybutylene-sebacate, polyethylene-adipate, polypropylene-adipate, polybutylene-adipate, polypentylene-adipate, polyhexylene-adipate, polyheptadene-adipate, polyoctalene-adipate, polyethylene-glutarate, polypropylene-glutarate, polybutylene-glutarate, polypentylene-glutarate, polyhexylene-glutarate, polyheptadene-glutarate, polyoctalene-glutarate polyethylene-pimelate, polypropylene-pimelate, polybutylene-pimelate, polypentylene-pimelate, polyhexylene-pimelate, polyheptadene-pimelate, poly(ethoxylated bisphenol A-fumarate), poly(ethoxylated bisphenol A-succinate), poly(ethoxylated bisphenol A-adipate), poly(ethoxylated bisphenol A-glutarate), poly (ethoxylated bisphenol A-terephthalate), poly(ethoxylated bisphenol A-isophthalate), poly(ethoxylated bisphenol A-dodecenylsuccinate), poly(propoxylated bisphenol A-fumarate), poly(propoxylated bisphenol A-succinate), poly (propoxylated bisphenol A-adipate), poly(propoxylated bisphenol A-glutarate), poly(propoxylated bisphenol A-terephthalate), poly(propoxylated bisphenol A-isophthalate), poly(propoxylated bisphenol A-dodecenylsuccinate), SPAR (Dixie Chemicals), BECKOSOL (Reichhold Inc), ARAKOTE (Ciba-Geigy Corporation), HETRON (Ashland Chemical), PARAPLEX (Rohm & Haas), POLYLITE (Reichhold Inc), PLASTHALL (Rohm & Haas), CYGAL (American Cyanamide), ARMCO (Armco Composites), ARPOL (Ashland Chemical), CELANEX (Celanese Eng), RYNITE (DuPont), STYPOL (Freeman Chemical Corporation) and combinations thereof. The resins can also be functionalized, such as carboxylated, sulfonated, or the like, and particularly such as sodio sulfonated, if desired.

The amorphous polyester resin may be a branched resin. As used herein, the terms "branched" or "branching" includes branched resin and/or cross-linked resins. Branching agents for use in forming these branched resins include, for example, a multivalent polyacid such as 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl) methane, and 1,2,7,8-octanetetracarboxylic acid, acid anhydrides thereof, and lower alkyl esters thereof, 1 to about 6 carbon atoms; a multivalent polyol such as sorbitol, 1,2,3,6-hexanetetrol, 1,4-sorbitane, pentaerythritol, dipentaerythritol, tripentaerythritol, sucrose, 1,2,4-butanetriol, 1,2,5-pentatriol, glycerol, 2-methylpropanetriol, 2-methyl-1,2,4-butanetriol, trimethylolethane, trimethylolpropane, 1,3,5-trihydroxymethylbenzene, mixtures thereof, and the like. The branching agent amount selected is, for example, from about 0.1 to about 5 mole percent of the resin.

Linear or branched unsaturated polyesters selected for reactions include both saturated and unsaturated diacids (or anhydrides) and dihydric alcohols (glycols or diols). The resulting unsaturated polyesters are reactive (for example, crosslinkable) on two fronts: (i) unsaturation sites (double bonds) along the polyester chain, and (ii) functional groups such as carboxyl, hydroxy, and the like groups amenable to acid-base reactions. Typical unsaturated polyester resins may be prepared by melt polycondensation or other polymerization processes using diacids and/or anhydrides and diols.

In embodiments, a suitable amorphous resin utilized in a toner of the present disclosure may be a low molecular weight amorphous resin, sometimes referred to, in embodiments, as an oligomer, having a weight average molecular weight (Mw) of from about 500 daltons to about 10,000 daltons, in embodiments from about 1000 daltons to about 5000 daltons, in other embodiments from about 1500 daltons to about 4000 daltons.

The low molecular weight amorphous resin may possess a glass transition temperature of from about 58.5° C. to about 66° C., in embodiments from about 60° C. to about 62° C.

The low molecular weight amorphous resin may possess a softening point of from about 105° C. to about 118° C., in embodiments from about 107° C. to about 109° C.

The low molecular weight amorphous polyester resins may have an acid value of from about 8 to about 20 mg KOH/g, in embodiments from about 9 to about 16 mg KOH/g, and in embodiments from about 11 to about 15 mg KOH/g.

In other embodiments, an amorphous resin utilized in forming a toner of the present disclosure may be a high molecular weight amorphous resin. As used herein, the high molecular weight amorphous polyester resin may have, for example, a number average molecular weight ($M_n$), as measured by gel permeation chromatography (GPC) of, for example, from about 1,000 to about 10,000, in embodiments from about 2,000 to about 9,000, in embodiments from about 3,000 to about 8,000, and in embodiments from about 6,000 to about 7,000. The weight average molecular weight ($M_w$) of the resin is greater than 45,000, for example, from about 45,000 to about 150,000, in embodiments from about 50,000 to about 100,000, in embodiments from about 63,000 to about 94,000, and in embodiments from about 68,000 to about 85,000, as determined by GPC using polystyrene standard. The polydispersity index (PD) is above about 4, such as, for example, greater than about 4, in embodiments from about 4 to about 20, in embodiments from about 5 to about 10, and in embodiments from about 6 to about 8, as measured by GPC versus standard polystyrene reference resins. The PD index is the ratio of the weight-average molecular weight ($M_w$) and the number-average molecular weight ($M_n$).

The high molecular weight amorphous polyester resins, which are available from a number of sources, can possess various melting points of, for example, from about 30° C. to about 140° C., in embodiments from about 75° C. to about 130° C., in embodiments from about 100° C. to about 125° C., and in embodiments from about 115° C. to about 124° C.

High molecular weight amorphous resins may possess a glass transition temperature of from about 53° C. to about 58° C., in embodiments from about 54.5° C. to about 57° C.

The amorphous resin(s) is generally present in the toner composition in various suitable amounts, such as from about 60 to about 90 weight percent, in embodiments from about 50 to about 65 weight percent, of the toner or of the solids.

In further embodiments, the combined amorphous resins may have a melt viscosity of from about 10 to about 1,000,000 Pa*S at about 130° C., in embodiments from about 50 to about 100,000 Pa*S.

In embodiments, the toner composition, including the core, may include at least one crystalline resin. As used herein, "crystalline" refers to a polyester with a three dimensional order. "Semicrystalline resins" as used herein refers to resins with a crystalline percentage of, for example, from about 10 to about 90%, in embodiments from about 12 to about 70%. Further, as used hereinafter "crystalline polyester resins" and "crystalline resins" encompass both crystalline resins and semicrystalline resins, unless otherwise specified.

In embodiments, the crystalline polyester resin is a saturated crystalline polyester resin or an unsaturated crystalline polyester resin.

For forming a crystalline polyester, suitable organic diols include aliphatic diols having from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like. The aliphatic diol may be, for example, selected in an amount of from about 40 to about 60 mole percent, in embodiments from about 42 to about 55 mole percent, in embodiments from about 45 to about 53 mole percent of the resin.

Examples of organic diacids or diesters selected for the preparation of the crystalline resins include oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and combinations thereof. The organic diacid may be selected in an amount of, for example, in embodiments from about 40 to about 60 mole percent, in embodiments from about 42 to about 55 mole percent, in embodiments from about 45 to about 53 mole percent.

Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly(decylene-sebacate), poly(decylene-decanoate), poly-(ethylene-decanoate), poly-(ethylene-dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), and combinations thereof. The crystalline resin may be present, for example, in an amount of from about 5 to about 25 percent by weight of the toner components, in embodiments from about 6 to about 15 percent by weight of the toner components.

The crystalline polyester resins, which are available from a number of sources, may possess various melting points of, for example, from about 30° C. to about 120° C., in embodiments from about 50° C. to about 90° C. The crystalline resins may have, for example, a number average molecular weight ($M_n$), as measured by gel permeation chromatography (GPC) of, for example, from about 1,000 to about 50,000, in embodiments from about 2,000 to about 25,000, in embodiments from about 3,000 to about 15,000, and in embodiments from about 6,000 to about 12,000. The weight average molecular weight ($M_w$) of the resin is 50,000 or less, for example, from about 2,000 to about 50,000, in embodiments from about 3,000 to about 40,000, in embodiments from about 10,000 to about 30,000 and in embodiments from about 21,000 to about 24,000, as determined by GPC using polystyrene standards. The molecular weight distribution ($M_w/M_n$) of the crystalline resin is, for example, from about 2 to about 6, in embodiments from about 3 to about 4. The crystalline polyester resins may have an acid value of about 2 to about 20 mg KOH/g, in embodiments from about 5 to about 15 mg KOH/g, and in embodiments from about 8 to about 13 mg KOH/g. The acid value (or neutralization number) is the mass of potassium hydroxide (KOH) in milligrams that is required to neutralize one gram of the crystalline polyester resin.

Suitable crystalline polyester resins include those disclosed in U.S. Pat. No. 7,329,476 and U.S. Patent Application Publication Nos. 2006/0216626, 2008/0107990, 2008/0236446 and 2009/0047593, the disclosures of each of which are hereby incorporated by reference in their entirety. In embodiments, a suitable crystalline resin may include a resin composed of ethylene glycol or nonanediol and a mixture of dodecanedioic acid and fumaric acid co-monomers with the following formula (II):

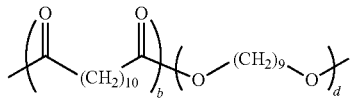

(II)

wherein b is from about 5 to about 2000 and d is from about 5 to about 2000.

If semicrystalline polyester resins are employed herein, the semicrystalline resin may include poly(3-methyl-1-butene), poly(hexamethylene carbonate), poly(ethylene-p-carboxy phenoxy-butyrate), poly(ethylene-vinyl acetate), poly(docosyl acrylate), poly(dodecyl acrylate), poly(octadecyl acrylate), poly(octadecyl methacrylate), poly(behenylpolyethoxyethyl methacrylate), poly(ethylene adipate), poly(decamethylene adipate), poly(decamethylene azelaate), poly(hexamethylene oxalate), poly(decamethylene oxalate), poly(ethylene oxide), poly(propylene oxide), poly(butadiene oxide), poly(decamethylene oxide), poly(decamethylene sulfide), poly(decamethylene disulfide), poly(ethylene sebacate), poly(decamethylene sebacate), poly(ethylene suberate), poly(decamethylene succinate), poly(eicosamethylene malonate), poly(ethylene-p-carboxy phenoxy-undecanoate), poly(ethylene dithionesophthalate), poly(methyl ethylene terephthalate), poly(ethylene-p-carboxy phenoxy-valerate), poly(hexamethylene-4,4'-oxydibenzoate), poly(10-hydroxy capric acid), poly(isophthalaldehyde), poly(octamethylene dodecanedioate), poly(dimethyl siloxane), poly(dipropyl siloxane), poly(tetramethylene phenylene diacetate), poly(tetramethylene trithiodicarboxylate), poly(trimethylene dodecane dioate), poly(m-xylene), polyp-xylylene pimelamide), and combinations thereof.

As noted above, in embodiments a toner of the present disclosure may also include at least one high molecular weight branched or cross-linked amorphous polyester resin. This high molecular weight resin may include, in embodiments, for example, a branched amorphous resin or amorphous polyester, a cross-linked amorphous resin or amorphous polyester, or mixtures thereof, or a non-cross-linked amorphous polyester resin that has been subjected to cross-linking. In accordance with the present disclosure, from about 1% by weight to about 100% by weight of the high molecular weight amorphous polyester resin may be branched or cross-linked, in embodiments from about 2% by weight to about 50% by weight of the higher molecular weight amorphous polyester resin may be branched or cross-linked.

As noted above, in embodiments, the resin may be formed by emulsion polymerization methods. Utilizing such methods, the resin may be present in a resin emulsion, which may then be combined with other components and additives to form a toner of the present disclosure.

Toner

The resins described above, in embodiments a combination of polyester resins, for example a low molecular weight amorphous resin, a high molecular weight amorphous resin, and a crystalline resin, may be utilized to form toner compositions. Such toner compositions may include optional colorants, waxes, and other additives. Toners may be formed utilizing any method within the purview of those skilled in the art including, but not limited to, emulsion aggregation methods.

Surfactants

In embodiments, resins, waxes, and other additives utilized to form toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of cationic surfactants which may be used, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Colorants

As the colorant to be added, various known suitable colorants, such as dyes, pigments, mixtures of dyes, mixtures of pigments, mixtures of dyes and pigments, and the like, may be included in the toner. The colorant may be included in the toner in an amount of, for example, about 0.1 to about 35 percent by weight of the toner, or from about 1 to about 15 weight percent of the toner, or from about 3 to about 10 percent by weight of the toner.

As examples of suitable colorants, mention may be made of carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like.

In embodiments, toners of the present disclosure may have high pigment loadings. As used herein, high pigment loadings include, for example, toners having a colorant in an amount of from about 7 percent by weight of the toner to about 40 percent by weight of the toner, in embodiments from about 10 percent by weight of the toner to about 18 percent by weight of the toner. These high pigment loadings are important to achieve fully saturated colors with high chroma, and particularly to enable a good color match to certain colors such as PANTONE® Orange, Process Blue, PANTONE® yellow, and the like. (The PANTONE® colors refer to one of the most popular color guides illustrating different colors, wherein each color is associated with a specific formulation of colorants, and is published by PANTONE, Inc., of Moonachie, N.J.)

Wax

Optionally, a wax may also be combined with the resin in forming toner particles. When included, the wax may be present in an amount of, for example, from about 1 weight percent to about 25 weight percent of the toner particles, in embodiments from about 5 weight percent to about 20 weight percent of the toner particles.

Waxes that may be selected include waxes having, for example, a weight average molecular weight of from about 500 to about 20,000, in embodiments from about 1,000 to about 10,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

Toner Preparation

The toner particles may be prepared by any method within the purview of one skilled in the art. Although embodiments relating to toner particle production are described below with respect to emulsion aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner-particle shape and morphology.

In embodiments, toner compositions may be prepared by emulsion aggregation processes, such as a process that includes aggregating a mixture of an optional wax and any other desired or required additives, and emulsions including the resins described above, optionally in surfactants as described above, and then coalescing the aggregate mixture. A mixture may be prepared by adding an optional wax or other materials, which may also be optionally in a dispersion(s) including a surfactant, to the emulsion, which may be a mixture of two or more emulsions containing the resin(s). The pH of the resulting mixture may be adjusted by an acid such as, for example, acetic acid, nitric acid or the like. In embodiments, the pH of the mixture may be adjusted to from about 2 to about 4.5. Additionally, in embodiments, the mixture may be homogenized. If the mixture is homogenized, homogenization may be accomplished by mixing at about 3,000 to about 4,000 revolutions per minute (rpm), in embodiments from about 3250 rpm to about 3750 rpm, while adding an aggregating agent over a period of time of from about 2 minutes to about 7 minutes, in embodiments from about 3 minutes to about 6 minutes. Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, and combinations thereof. In embodiments, the aggregating agent may be added to the mixture at a temperature that is below the glass transition temperature (Tg) of the resin.

The aggregating agent may be added to the mixture utilized to form a toner in an amount of, for example, from about 0.1 pph to about 3 pph, in embodiments from about 0.25 pph to about 2 pph, in embodiments about 1.5 pph. This provides a sufficient amount of agent for aggregation.

The gloss of a toner may be influenced by the amount of retained metal ion, such as $Al^{3+}$, in the particle. The amount of retained metal ion may be further adjusted by the addition of a chelating agent, in embodiments ethylene diamine tetraacetic acid (EDTA). In embodiments, the amount of retained aluminum, for example $Al^{3+}$, in the dry toner particles of the present disclosure may be from about 30 parts per million (ppm) to about 1,000 ppm, in embodiments from about 60 ppm to about 900 ppm.

As noted above, the particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature to, for example, from about 40° C. to about 60° C., and holding the mixture at this temperature for a time from about 0.5 hours to about 6 hours, in embodiments from about hour 1 to about 5 hours, while maintaining stirring, to provide the aggregated particles.

Once the particle size has reached the target size, the growth of toner particles is halted, sometimes referred to as the freezing step, with the use of a base such as sodium hydroxide (NaOH) and, in embodiments, the addition of a chelating agent such as EDTA. The temperature at which the chelating agent is added can affect how much aluminum is actually chelated. At higher temperatures, the toner particle clusters are more tightly packed together, thus trapping and binding more aluminum within the particles. The tighter the network, the harder it is for the chelating agent to remove the aluminum; resulting in higher levels of aluminum in the final toner particle.

Thus, in embodiments, the freeze temperature, i.e., the temperature at which the particles are heated to stop growth, may be from about 35° C. to about 60° C., in embodiments from about 40° C. to about 55° C.; the solids content of the latexes including the resins utilized to form the toner particles may be from about 10% by weight to about 20% by weight, in embodiments from about 11% by weight to about 15% by weight; and the initial particle size of the particles to be aggregated may be from about 1 micron to about 4 microns, in embodiments from about 1.5 microns to about 3 microns.

In accordance with the present disclosure, it has been found that the desired aluminum content may be influenced by the freeze temperature. The freeze temperature, in turn, may be influenced by the mixing speed and set up, solids content, initial particle size of the particles to be aggregated, and initial toner slurry pH. In accordance with the present disclosure, achieving the desired aluminum content in the final toner can be calculated and arrived at from the desired freeze temperature based upon mixing speed (dependent on set-up), solids content, initial size of the particles, and initial toner slurry pH. For example, several formulae have been developed using the methods of the present disclosure, including the following three formulae:

1) for a highly pigmented black toner, $y=2.616x-57.213$; (III)
2) for a highly pigmented magenta toner, $y=3.8993x-87.31$; and (IV)
3) for a highly pigmented cyan toner, $y=4.5171x-143.69$. (V)

For each of the above equations, y is the desired Aluminum content, and x is the freeze temperature, in degrees Celsius.

The above formulae (III-V) were obtained as described in greater detail below in the Examples using various factors such as mixing, solids content, initial toner particle size and initial toner slurry pH to achieve various freeze temperatures. These toners were then washed and dried and analyzed for aluminum ion content by ICP (inductively coupled plasma).

In embodiments, the resulting toner particles may have a volume average diameter (also referred to as "volume average particle diameter") of less than about 8 microns, in embodiments from about 4 microns to about 5 microns, in embodiments from about 4.5 microns to about 6 microns.

Shell Resin Emulsion

In embodiments, after aggregation, but prior to coalescence, a shell may be applied to the aggregated particles.

Resin emulsions which may be utilized to form the shell include, but are not limited to, the amorphous resin emulsions described above for use in the core. Such an amorphous resin emulsion may include a low molecular weight resin, a high molecular weight resin, or combinations thereof. In embodiments, an amorphous resin emulsion which may be used to form a shell in accordance with the present disclosure may include an amorphous polyester of formula I above.

A single polyester resin emulsion may be utilized as the shell or, as noted above, in embodiments a first polyester resin may be combined with other resins to form a shell. Multiple resins emulsions may be utilized in any suitable amounts. In embodiments, a first amorphous polyester resin emulsion, for example a low molecular weight amorphous resin of formula I above, may be present in an amount of from about 20 percent by weight to about 100 percent by weight of the total shell resin, in embodiments from about 30 percent by weight to about 90 percent by weight of the total shell resin. Thus, in embodiments a second resin, in embodiments a high molecular weight amorphous resin, may be present in the shell resin in an amount of from about 0 percent by weight to about 80 percent by weight of the total shell resin, in embodiments from about 10 percent by weight to about 70 percent by weight of the shell resin.

Coalescence

Following aggregation to the desired particle size, with the formation of an optional shell as described above, the particles may then be coalesced to the desired final shape, the coalescence being achieved by, for example, heating the mixture to a temperature of from about 55° C. to about 100° C., in embodiments from about 65° C. to about 90° C., in embodiments about 85° C. Higher or lower temperatures may be used, it being understood that the temperature is a function of the resins used for the binder.

Coalescence may proceed and be accomplished over a period of from about 0.1 to about 9 hours, in embodiments from about 0.5 to about 4 hours.

After coalescence, the mixture may be cooled to a lower temperature, such as from about 20° C. to about 40° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

Additives

In embodiments, the toner particles may also contain other optional additives, as desired or required. For example, the toner may include any known charge additives in amounts of from about 0.1 to about 10 weight percent, and in embodiments of from about 0.5 to about 7 weight percent of the toner. Examples of such charge additives include alkyl pyridinium halides, bisulfates, the charge control additives of U.S. Pat. Nos. 3,944,493, 4,007,293, 4,079,014, 4,394,430 and 4,560,635, the disclosures of each of which are hereby incorporated by reference in their entirety, negative charge enhancing additives like aluminum complexes, and the like.

Surface additives can be added to the toner compositions of the present disclosure after washing or drying. Examples of such surface additives include, for example, metal salts, metal salts of fatty acids, colloidal silicas, metal oxides, strontium titanates, mixtures thereof, and the like. Surface additives may be present in an amount of from about 0.1 to about 10 weight percent, and in embodiments of from about 0.5 to about 7 weight percent of the toner. Examples of such additives include those disclosed in U.S. Pat. Nos. 3,590,000, 3,720,617, 3,655,374 and 3,983,045, the disclosures of each of which are hereby incorporated by reference in their entirety. Other additives include zinc stearate and AEROSIL R972® available from Degussa. The coated silicas of U.S. Pat. Nos. 6,190,815 and 6,004,714, the disclosures of each of which are hereby incorporated by reference in their entirety, can also be present in an amount of from about 0.05 to about 5 percent, and in embodiments of from about 0.1 to about 2 percent of the toner, which additives can be added during the aggregation or blended into the formed toner product.

The characteristics of the toner particles may be determined by any suitable technique and apparatus. Volume average particle diameter ($D_{50v}$), GSDv, and GSDn may be measured by means of a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3. Toners produced in accordance with the present disclosure may possess excellent charging characteristics when exposed to extreme relative humidity (RH) conditions. The low-humidity zone (C zone) may be about 10° C./15% RH, while the high humidity zone (A zone) may be about 28° C./85% RH. Toners of the present disclosure may also possess a parent toner charge per mass ratio (Q/M) of from about −3 μC/g to about −35 μC/g, and a final toner charging after surface additive blending of from −10 μC/g to about −45 μC/g.

Utilizing the methods of the present disclosure, aggregation of the toner particles may be adjusted based upon solids content, speed of mixing, and temperature for freezing to arrive at a desired amount of residual aluminum ions in the toner and thus desired gloss levels. Thus, for example, the gloss level of a toner of the present disclosure may have a peak gloss as measured on Color Xpressions Select (CXS) paper from XEROX Corporation, in Gardner Gloss Units (ggu) by a Gardner Gloss Meter at an angle of 75°, of from about 10 ggu to about 100 ggu, in embodiments from about 20 ggu to about 80 ggu.

In embodiments, toners of the present disclosure may be utilized as ultra low melt (ULM) toners. In embodiments, the dry toner particles, exclusive of external surface additives, may have the following characteristics:

(1) Volume average diameter of from about 2.5 to about 20 microns, in embodiments from about 2.75 to about 18 microns, in other embodiments from about 3 to about 15 microns.

(2) Number Average Geometric Standard Deviation (GSDn) and/or Volume Average Geometric Standard Deviation (GSDv) of from about 1.18 to about 1.35, in embodiments from about 1.20 to about 1.34.

(3) Circularity of from about 0.9 to about 1 (measured with, for example, a Sysmex FPIA 2100 analyzer), in embodiments form about 0.95 to about 0.985, in other embodiments from about 0.96 to about 0.98.

(4) A minimum fixing temperature of from about 120° C. to about 160° C., in embodiments from about 130° C. to about 150° C.

Developers

The toner particles thus formed may be formulated into a developer composition. The toner particles may be mixed with carrier particles to achieve a two-component developer composition. The toner concentration in the developer may be from about 1% to about 25% by weight of the total weight of the developer, in embodiments from about 2% to about 15% by weight of the total weight of the developer.

Carriers

Examples of carrier particles that can be utilized for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include fluoropolymers, such as polyvinylidene fluoride resins, terpolymers of styrene, methyl methacrylate, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used. In embodiments, polyvinylidenefluoride and polymethylmethacrylate (PMMA) may be mixed in proportions of from about 30 to about 70 weight % to about 70 to about 30 weight %, in embodiments from about 40 to about 60 weight % to about 60 to about 40 weight %. The coating may have a coating weight of, for example, from about 0.1 to about 5% by weight of the carrier, in embodiments from about 0.5 to about 2% by weight of the carrier.

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 to about 10 percent by weight, in embodiments from about 0.01 percent to about 3 percent by weight, based on the weight of the coated carrier particles, until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 μm in size, in embodiments from about 50 to about 75 μm in size, coated with about 0.5% to about 10% by weight, in embodiments from about 0.7% to about 5% by weight of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations are may be from about 1% to about 20% by weight of the toner composition. However, different toner and carrier percentages may be used to achieve a developer composition with desired characteristics.

Imaging

The toners can be utilized for electrophotographic processes, including those disclosed in U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with an electrophotographic device including a charging component, an imaging component, a photoconductive component, a developing component, a transfer component, and a fusing component. In embodiments, the development component may include a developer prepared by mixing a carrier with a toner composition described herein. The electrophotographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser roll member. Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 70° C. to about 160° C., in embodiments from about 80° C. to about 150° C., in other embodiments from about 90° C. to about 140° C., after or during melting onto the image receiving substrate.

Utilizing the methods of the present disclosure, highly pigmented toners may be produced which require less toner to obtain the same image. These highly pigmented toners may exhibit an increase in pigment loading of about 45% higher than nominal. Reducing the toner mass per unit area (TMA) on the print results in a thinner toner layer. To compensate for the reduced TMA, and still get the correct optical density, the loading of pigment in the toner should be increased proportionally to the TMA reduction, so that the total amount of pigment in the image layer is the same. This reduces the toner run cost proportionally to the TMA reduction. The thinner toner layers also result in more of an offset look and feel for the print, as offset inks produce thin image layers on the print.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 30° C.

EXAMPLES

Example 1

A black toner was prepared having 12% solids and a low freeze temperature. The black toner was a polyester EA toner prepared at a 2 liter batch size (about 170 grams dry theoretical toner). About 94 grams of a high molecular weight amorphous resin in an emulsion, the amorphous resin having a molecular weight of about 85,000 and including alkoxylated bisphenol A with terephthalic acid, trimellitic acid, and dodecenylsuccinic acid co-monomers (hereinafter "High MW Amorphous Resin"), was combined with about 99 grams of a low molecular weight amorphous resin in an emulsion, the amorphous resin having a molecular weight of about 20,000 and including an alkoxylated bisphenol A with terephthalic acid, fumaric acid, and dodecenylsuccinic acid co-monomers (hereinafter "Low MW Amorphous Resin").

About 33 grams of a crystalline resin in an emulsion was added thereto. The crystalline resin was of the following formula:

(II)

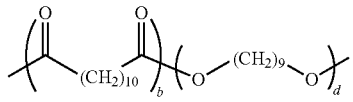

wherein b was from about 5 to about 2000 and d was from about 5 to about 2000.

Also added thereto was about 3.4 grams of an alkyldiphenyloxide disulfonate, commercially available as DOWFAX™ 2A1 from The Dow Chemical Company in about 598 grams of deionized water, about 49 grams of a polyethylene wax (from IGI) in a dispersion, about 15.8 grams of a cyan pigment dispersion (Pigment Blue 15:3 from Sun Chemical) and about 93.3 grams of a black pigment dispersion (Nippex 35 from Evonik). The above components were mixed and the pH was then adjusted to 4.2 using 0.3 M nitric acid. The slurry was then homogenized for about 5 minutes at a rate of from about 3000 to about 4000 rpm while adding a solution including about 3.05 grams of aluminum sulfate in about 35 grams deionized water. The slurry was then transferred to a 2 liter Buchi reactor and mixing commenced at a rate of about 460 rpm. The slurry was aggregated at a batch temperature of about 34° C. During aggregation, a shell including the same amorphous emulsions described above was added and the batch was further heated to about 40° C. to achieve the targeted particle size.

Once the target particle size of about 5.5 was obtained, with pH adjustment using about 4% sodium hydroxide (NaOH) solution to achieve a pH of about 4.5, a chelating solution including about 6.54 grams of ethylene diamine tetraacetic acid (EDTA) (commercially available as VERSENE-100 from The Dow Chemical Company), in about 33 grams water was added thereto and the pH was further adjusted to about 7.8 with the addition of 4% NaOH to freeze, i.e., stop, the aggregation step. The process continued with the reactor temperature (Tr) increased to about 85° C. The pH of the slurry was maintained at about 7.8 until a temperature of about 80° C. was reached, then at about 85° C. the pH was adjusted to about 6.5 using a sodium acetate/acetic acid buffer having a pH of about 5.7, at which point the particles began to coalesce. After about 30 minutes, the particles had a circularity of >0.965 (measured with, for example, a SYSMEX FPIA 2100 analyzer) and were cooled. Final toner particle size ($D_{50}$), Volume Average Geometric Standard Deviation (GSDv) and Number Average Geometric Standard Deviation (GSDn) were 5.42/1.19/1.27, respectively. The fines (particles of from about 1 to about 4 microns) content, coarse (particles>16 microns in size) content, and circularity were 23.03%, 0.12% and 0.977, respectively.

Example 2

A black toner was prepared having 14% solids and a high freeze temperature. The black toner was a polyester EA toner prepared at a 2 liter batch size (about 180 grams dry theoretical toner). The process of Example 1 was followed. The same materials described above in Example 1 were used, but in differing amounts: About 100 grams of the High MW Amorphous Resin, about 104 grams of the Low MW Amorphous Resin, about 35 grams of the crystalline emulsion, about 3.6 grams of the DOWFAX™ 2A1 alkyldiphenyloxide disulfonate in about 486 grams of deionized water, about 52 grams of the polyethylene wax (from IGI), about 17 grams of the cyan pigment dispersion, and about 98.8 grams of the black pigment.

In this Example, about 3.23 grams aluminum sulfate mixed with 37 grams deionized water was used as the aggregating agent, with aggregation occurring at a batch temperature of about 42° C. During aggregation, a shell including the same amorphous emulsions was added and then the batch was further heated to 47° C. to achieve the targeted particle size of about 5.5. A chelating solution containing about 6.92 grams of EDTA, commercially available as VERSENE-100 from The Dow Chemical Company, in about 42 grams water was added thereto and the pH was further adjusted to about 7.8, to freeze, i.e., stop, the aggregation step. The process continued as described above in Example 1, with coalescence of the particles. After about 30 minutes the particles had a circularity >0.965 and were cooled. Final toner particle size ($D_{50}$), GSDv and GSDn were 5.48/1.22/1.20, respectively. The fines (1-4 microns) content, coarse (>16 microns) content, and circularity of the particles thus obtained were 12.84%, 1.16% and 0.974, respectively.

Table 1 below summarizes the results for the toners produced in Examples 1 and 2:

TABLE 1

| Toner ID | Example 1 | Example 2 |
|---|---|---|
| % solids before shell | 12 | 14 |
| Freeze Temp. | 40° C. | 47° C. |

TABLE 1-continued

| Toner ID | Example 1 | Example 2 |
|---|---|---|
| $Al_2(SO_4)_3$ | 0.5 pph | 0.5 pph |
| VERSENE-100 (EDTA) | 1.5 pph | 1.5 pph |
| D50 | 5.37 | 5.48 |
| GSDv | 1.19 | 1.22 |
| GSDn | 1.27 | 1.20 |
| Circularity | 0.977 | 0.974 |
| Al [ppm] | 39.7 | 75.6 |

The aluminum ions were all measured by ICP (Inductively Coupled Plasma).

Example 3

A black toner was prepared having an average particle size of about 5.6 μm and a high freeze temperature. The black toner was a polyester EA toner prepared at a 2 liter batch size (about 270 grams dry theoretical toner). The process of Example 1 was followed. The same materials described above in Example 1 were used, but in differing amounts: About 142 grams of the High MW Amorphous Resin, about 153 grams of the Low MW Amorphous Resin, about 53 grams of the crystalline emulsion, about 1.87 grams of the DOWFAX™ 2A1 alkyldiphenyloxide disulfonate in about 677 grams of deionized water, about 82 grams of the polyethylene wax (from IGI), about 26.5 grams of the cyan pigment dispersion, and about 156 grams of the black pigment.

In this Example, about 4.85 grams aluminum sulfate mixed with 129 grams deionized water was used as the aggregating agent, with aggregation occurring at a batch temperature of about 34° C. During aggregation, a shell including the same amorphous emulsions was added and then the batch was further heated to 51.8° C. to achieve the targeted particle size of about 5.7. A chelating solution containing about 10.39 grams of EDTA, commercially available as VERSENE-100 from The Dow Chemical Company, in about 10 grams water was added thereto and the pH was further adjusted to about 7.8, to freeze, i.e., stop, the aggregation step. The process continued as described above in Example 1, with coalescence of the particles. After about 30 minutes the particles had a circularity >0.965 and were cooled. Final toner particle size ($D_{50}$), GSDv and GSDn were 5.70/1.19/1.207, respectively. The fines (1-4 microns) content, coarse (>16 microns) content, and circularity of the particles thus obtained were 7.47%, 0.19% and 0.967, respectively.

Example 4

A black toner was prepared having an average particle size of about 5.2 μm and a low freeze temperature. The black toner was a polyester EA toner prepared at a 2 liter batch size (about 270 grams dry theoretical toner). The process of Example 1 was followed. The same materials described above in Example 1 were used, but in differing amounts: About 144 grams of the High MW Amorphous Resin, about 156 grams of the Low MW Amorphous Resin, about 53 grams of the crystalline emulsion, about 1.9 grams of the DOWFAX™ 2A1 alkyldiphenyloxide disulfonate in about 675 grams of deionized water, about 82 grams of the polyethylene wax (from IGI), about 25 grams of the cyan pigment dispersion, and about 148 grams of the black pigment.

In this Example, about 4.85 grams aluminum sulfate mixed with 129 grams deionized water was used as the aggregating agent, with aggregation occurring at a batch temperature of about 34° C. During aggregation, a shell including the same amorphous emulsions was added and then the batch was further heated to 51.4° C. to achieve the targeted particle size of about 5.2. A chelating solution containing about 10.39 grams of EDTA, commercially available as VERSENE-100 from The Dow Chemical Company, in about 10 grams water was added thereto and the pH was further adjusted to about 7.8, to freeze, i.e., stop, the aggregation step. The process continued as described above in Example 1, with coalescence of the particles. After about 30 minutes the particles had a circularity >0.965 and were cooled. Final toner particle size ($D_{50}$), GSDv and GSDn were 5.25/1.19/1.18, respectively. The fines (1-4 microns) content, coarse (>16 microns) content, and circularity of the particles thus obtained were 13.11%, 0.0% and 0.966, respectively.

Table 2 below summarizes the results for the toners produced in Examples 3 and 4:

TABLE 2

| Toner ID | Particle size | Solids | $Al_2(SO_4)_3$ | VERSENE-100 (EDTA) | Freeze Temp. | Al ion |
|---|---|---|---|---|---|---|
| Example 3 | 5.6 microns | 12% | 0.5 pph | 1.5 pph | 51.75° C. | 80 ppm |
| Example 4 | 5.2 microns | 12% | 0.5 pph | 1.5 pph | 51.35° C. | 80 ppm |

From the above four examples, it can be seen that factors such as particle size and % solids could change, but the temperature at which the toner was frozen determined the level of aluminum ion remaining in the toner (for the same aluminum sulfate and EDTA levels).

Figure 2:
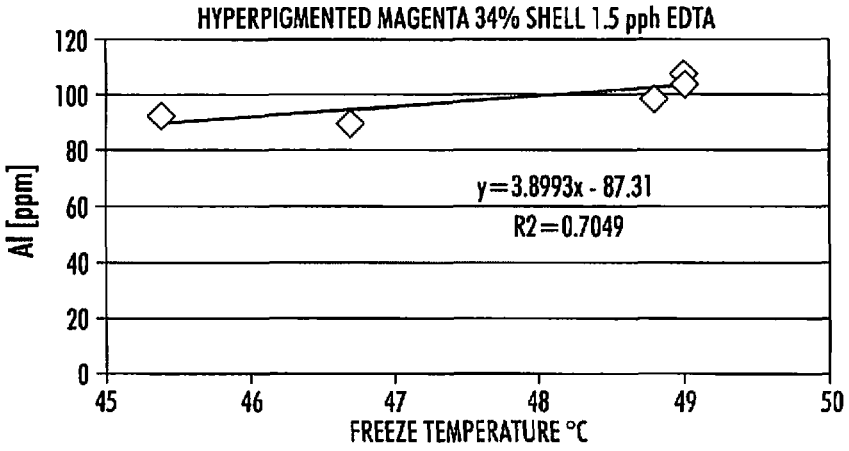
FIG. 2 is a graph depicting the amount of aluminum in a highly pigmented magenta toner treated with EDTA, as a function of freeze temperature.
Figure 3:
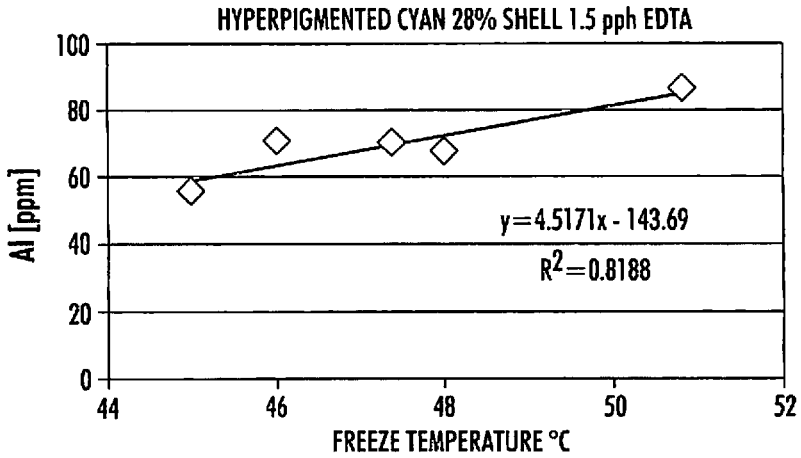
FIG. 3 is a graph depicting the amount of aluminum in a highly pigmented cyan toner treated with EDTA, as a function of freeze temperature.

The figures include examples of similarly made toners at the 2 liter and 20 gallon scale, following the same syntheses from Examples 1-4 above, where there was enough data to plot and determine if the correlation changed with scale or toner color. FIG. 1 is a graph demonstrating the amounts of aluminum ions in parts per million (ppm) as a function of freeze temperature for a highly pigmented black toner, with 34% of the same amorphous resin emulsions as in the core as a shell and 1.5 parts per hundred (pph) EDTA, for a 2 liter size batch; FIG. 2 is a graph demonstrating the amounts of aluminum ions in parts per million (ppm) as a function of freeze temperature for a highly pigmented magenta toner, with 34% of the same amorphous resin emulsions as in the core as a shell and 1.5 parts per hundred (pph) EDTA for a 20 gallon size batch; and FIG. 3 is a graph demonstrating the amounts of aluminum ions in parts per million (ppm) as a function of freeze temperature for a highly pigmented cyan toner, with 28% of the same amorphous resin emulsions as in the core as a shell and 1.5 parts per hundred (pph) EDTA for a 20 gallon size batch.

As noted above, the following formulae were derived:

1) for a highly pigmented black toner, y=2.616x−57.213; (III)
2) for a highly pigmented magenta toner, y=3.8993x−87.31; and (IV)
3) for a highly pigmented cyan toner, y=4.5171x−143.69. (V)

For each of the above equations, y is the desired Aluminum content, and x is the freeze temperature, in degrees Celsius.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A process comprising:

determining a gloss level for a dry final toner produced with an aggregating agent comprising aluminum by reducing amount of aluminum remaining in the dry final toner to an amount to produce the gloss level, wherein the amount of aluminum in the dry final toner to produce the gloss level directly correlates with temperature in a freezing step;

providing one or more resins selected from the group consisting of an amorphous resin, a crystalline resin, and combinations thereof, optionally in combination with colorants and waxes to form a toner slurry;

adjusting the toner slurry to a pH of from about 2 to about 5, having an overall toner slurry solids content of from about 10% to about 20%;

homogenizing the toner slurry at a speed of from about 3,000 revolutions per minute (rpm) to about 4,000 rpm, in presence of the aggregating agent at a temperature from about 40° C. to about 60° C. to form a mixture;

aggregating the mixture to form aggregated particles at a temperature lower than a temperature to freeze particle size and at a speed of from about 100 rpm to about 900 rpm;

freezing particle size at a temperature from about 35° C. to about 60° C., wherein freezing comprises adding a chelating agent to said mixture, thereby forming toner particles; and recovering the toner particles, wherein the temperature of freezing particle size of said toner comprising a black colorant is calculated using a formula as follows:

$$y=2.616x-57.213 \quad \text{(III)}$$

the temperature of freezing particle size of said toner comprising a magenta colorant is calculated using a formula as follows:

$$y=3.8993x-87.31 \quad \text{(IV)}$$

and the temperature of freezing particle size of said toner comprising a cyan colorant is calculated using a formula as follows:

$$y=4.5171x-143.69 \quad \text{(V)}$$

wherein y in each of the above formula III, IV, and V is the desired aluminum content in parts per million, and x in each of the above formula III, IV, and V is the temperature of freezing, in degrees Celsius.

2. The process of claim 1, wherein the one of more resins comprise amorphous polyester resins and crystalline polyester resins.

3. The process of claim 1, wherein the amorphous resin comprises an amorphous polyester resin comprising an alkoxylated bisphenol A fumarate/terephthalate based polyester or copolyester resin.

4. The process of claim 1, wherein the crystalline resin is of the formula:

(II)

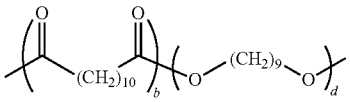

wherein b is from about 5 to about 2000 and d is from about 5 to about 2000.

5. The process of claim 1, wherein the aggregating agent is selected from the group consisting of polyaluminum halides, polyaluminum silicates, and water soluble aluminum salts.

6. The process of claim 1, wherein the aggregating agent is selected from the group consisting of polyaluminum chloride, polyaluminum bromide, polyaluminum fluoride, polyaluminum iodide, polyaluminum sulfosilicate, aluminum chloride, aluminum nitrite, aluminum sulfate, potassium aluminum sulfate, and combinations thereof.

7. The process of claim 1, wherein said chelating agent comprises ethylenediamine tetraacetic add.

8. The process of claim 1, wherein the toner particles have an aluminum content of from about 30 parts per million to about 1000 parts per million.

9. The process of claim 1, wherein the toner has a peak gloss from about 10 ggu to about 100 ggu.

10. A process comprising:

determining a gloss level for a toner produced with an aggregating agent selected from the group consisting of polyaluminum halides, polyaluminum silicates, and water soluble aluminum salts by reducing amount of aluminum remaining in the toner to an amount to produce the gloss level, wherein the amount of aluminum in the toner to produce the gloss level directly correlates with temperature in a freezing step;

providing one or more resins comprising at least one amorphous resin and at least one crystalline resin, optionally in combination with colorants and waxes to form a toner slurry;

adjusting the toner slurry to a pH of from about 2 to about 5, having an overall toner slurry solids content of from about 10% to about 20%;

homogenizing the toner slurry at a speed of from about 3,000 revolutions per minute (rpm) to about 4,000 rpm at a temperature of from about 40° C. to about 60° C., in presence of the aggregating agent to form a mixture;

aggregating the mixture to form aggregated particles at a temperature lower than a temperature to freeze particle size and at a speed from about 100 rpm to about 900 rpm;

freezing particle size at a temperature of from about 35° C. to about 60° C., wherein freezing comprises adding a chelating agent to said mixture, thereby forming toner particles; and recovering the toner particles, wherein the temperature of freezing toner particle size of said toner comprising a black colorant is calculated using a formula as follows:

$$y=2.616x-57.213 \quad \text{(III)}$$

the temperature of freezing particle size of said toner comprising a magenta colorant is calculated using a formula as follows:

$$y=3.8993x-87.31 \quad \text{(IV)}$$

and the temperature of freezing particle size of said toner comprising a cyan colorant is calculated using a formula as follows:

$$y=4.5171x-143.69 \quad \text{(V)}$$

wherein y in each of the above formula III, IV, and V is the desired aluminum content in parts per million, and x in each of the above formula III, IV, and V is the temperature of freezing, in degrees Celsius.

11. The process of claim 10, wherein the amorphous resin comprises an amorphous polyester resin comprising an alkoxylated bisphenol A fumarate/terephthalate based polyester or copolyester resin, and wherein the crystalline resin is of the formula:

(II)

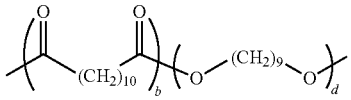

wherein b is from about 5 to about 2000 and d is from about 5 to about 2000, and combinations thereof.

12. The process of claim 10, wherein the aggregating agent is selected from the group consisting of polyaluminum chloride, polyaluminum bromide, polyaluminum fluoride, polyaluminum iodide, polyaluminum sulfosilicate, aluminum chloride, aluminum nitrite, aluminum sulfate, potassium aluminum sulfate, and combinations thereof.

13. The process of claim 10, wherein said chelating agent comprises ethylene diamine tetraacetic acid.

14. The process of claim 10, wherein the toner has a peak gloss from about 10 ggu to about 100 ggu.

15. A process comprising:

determining a gloss level for a highly pigmented dry final toner produced with an aggregating agent comprising aluminum, the highly pigmented toner selected from the group consisting of a black toner, a magenta toner, and a cyan toner, pigmented with from about 5% to about 50% pigment, by reducing the amount of aluminum remaining in the dry final toner to an amount to produce the gloss level, wherein the amount of aluminum in the toner to produce the gloss level directly correlates with temperature in a freezing step;

providing one or more aqueous dispersions, the aqueous dispersions comprising particles comprising particles of one or more resins, optionally in combination with colorants and waxes;

homogenizing the aqueous dispersions at a speed from about 3,000 revolutions per minute (rpm) to about 4,000 rpm and at a temperature of from about 40° C. to about 60° C., in the presence of the aggregating agent comprising aluminum to form a mixture;

aggregating the mixture to form aggregated particles at a temperature lower than a temperature to freeze particle size and at a speed from about 100 rpm to about 900 rpm;

freezing particle growth at a temperature of from about 35° C. to about 60° C. wherein freezing comprises adding a chelating agent to said mixture, thereby forming toner particles; and recovering the toner particles, wherein the temperature of freezing of the highly pigmented black toner particles is calculated using a formula as follows:

$$y=2.616x-57.213 \quad \text{(III)}$$

the temperature of freezing of the highly pigmented magenta toner is calculated using a formula as follows:

$$y=3.8993x-87.31 \quad \text{(IV)}$$

and the temperature of freezing of the highly pigmented cyan toner is calculated using a formula as follows:

$$y=4.5171x-143.69 \quad \text{(V)}$$

wherein y in each of the above formula III, IV, and V is the desired aluminum content in parts per million, and x in each of the above formula III, IV, and V is the temperature of freezing, in degrees Celsius.

16. The process of claim 15, wherein the aggregating agent is selected from the group consisting of polyaluminum chloride, polyaluminum bromide, polyaluminum fluoride, polyaluminum iodide, polyaluminum sulfosilicate, aluminum chloride, aluminum nitrite, aluminum sulfate, potassium aluminum sulfate, and combinations thereof, and wherein heating the aggregated particles occurs at a temperature of from about 35° C. to about 60° C.

17. The process of claim 15, wherein the one or more resins comprise an amorphous polyester resin comprising an alkoxylated bisphenol A fumarate/terephthalate based polyester or copolyester resin.

18. The process of claim 15, wherein the one or more resins comprise a crystalline resin of the formula:

(II)

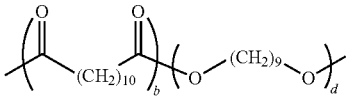

wherein b is from about 5 to about 2000 and d is from about 5 to about 2000, and combinations thereof.

19. The process of claim 15, wherein the toner has a peak gloss from about 10 ggu to about 100 ggu.

20. The process of claim 15, wherein said chelating agent comprises ethylene diamine tetraacetic acid.

* * * * *